US009809939B1

(12) United States Patent
Tian et al.

(10) Patent No.: US 9,809,939 B1
(45) Date of Patent: Nov. 7, 2017

(54) SEMISOLID COLLECTION DEVICE WITH A SHOVELING ASSEMBLY

(71) Applicant: Mango IOT Co., Ltd., Changzhou (CN)

(72) Inventors: Guolin Tian, Changzhou (CN); Chun Xu, Changzhou (CN)

(73) Assignee: MANGO IOT CO., LTD., Changzhou, Jiangsu Province (CN)

( * ) Notice: Subject to any disclaimer, the term of this patent is extended or adjusted under 35 U.S.C. 154(b) by 0 days.

(21) Appl. No.: 15/594,832

(22) Filed: May 15, 2017

(51) Int. Cl.
*A01K 29/00* (2006.01)
*E01H 1/12* (2006.01)
*A47G 21/04* (2006.01)

(52) U.S. Cl.
CPC ..... *E01H 1/1206* (2013.01); *A47G 21/045* (2013.01); *E01H 1/12* (2013.01); *E01H 2001/122* (2013.01)

(58) Field of Classification Search
CPC ..... E01H 1/1206; A47G 21/045
USPC ..... 294/1.3, 1.4, 1.5, 176; 119/170, 867; 15/257.1; 241/168
See application file for complete search history.

(56) References Cited

U.S. PATENT DOCUMENTS 4,102,547 A * 7/1978 Williams ..... E01H 1/1206 15/257.3
5,009,131 A * 4/1991 Alto ..... E04D 15/003 299/37.1
5,076,627 A * 12/1991 Simon ..... B07B 1/02 209/417
5,344,200 A * 9/1994 Yoshioka ..... A01K 23/005 294/1.5
6,416,097 B1 * 7/2002 O'Rourke ..... A01K 1/0114 209/418
6,681,658 B1 * 1/2004 O'Neal ..... E04D 15/003 294/49
6,941,896 B1 * 9/2005 Morin ..... E01H 1/1206 119/867
7,032,940 B1 * 4/2006 Smith ..... E01H 1/1206 294/1.3
7,780,209 B1 * 8/2010 Morrissey ..... A01K 23/005 294/1.5
8,544,910 B1 * 10/2013 Weist ..... A01B 1/022 294/49
2005/0248166 A1 * 11/2005 Warren ..... A01B 1/02 294/49

(Continued)

*Primary Examiner* — Paul T Chin
(74) *Attorney, Agent, or Firm* — Jackson IPG PLLC; Demian K. Jackson

(57) ABSTRACT

A semisolid collection device includes a shoveling assembly in a housing and including a retractable scoop, a canopy rotatably put on the scoop, and a roller above the scoop with the canopy moveably passing its surface; a motor including a conveyor belt driven by a motor shaft, and a forward and reverse switch for activating the motor or not; a clamping assembly including first and second clamping plates with the canopy passing therebetween; a transmitting assembly including a reciprocating screw driven by the conveyor belt, a sliding block put on the reciprocating screw, and a mount with the other end of the reciprocating screw disposed therein; two parallel guide rails having one ends secured to the mount; and a connection member secured to the scoop with the other ends of the guide rails and the sliding block secured thereto.

1 Claim, 3 Drawing Sheets

(56) References Cited

U.S. PATENT DOCUMENTS

| | | | | |
|---|---|---|---|---|
| 2007/0024070 | A1* | 2/2007 | Aihiokhai | E01H 1/0845<br>294/1.4 |
| 2015/0143706 | A1* | 5/2015 | Bek | B27B 19/006<br>30/393 |

* cited by examiner

SEMISOLID COLLECTION DEVICE WITH A SHOVELING ASSEMBLY

BACKGROUND OF THE INVENTION

1. Field of the Invention

The invention relates to semisolid (e.g., animal feces, grease, cakes, or towels) collection devices and more particularly to a semisolid collection device having improved characteristics.

2. Description of Related Art

Conventionally, semisolid (e.g., animal feces) is collected by wrapping in a bag prior to disposal. This is not convenient and hygienic. Animal feces collection devices are commercially available. However, they are complicated in terms of components and mechanism.

Thus, the need for improvement still exists.

SUMMARY OF THE INVENTION

It is therefore one object of the invention to provide a semisolid collection device comprising a housing; a shoveling assembly disposed in the housing and including a scoop, a canopy put on the scoop, and a roller above the scoop with the canopy moveably passing its surface; a motor including a motor shaft, a conveyor belt driven by the motor shaft, and a forward and reverse switch for activating the motor or not; a clamping assembly secured to the housing and including first and second clamping plates with the canopy passing therebetween; a transmitting assembly including a reciprocating screw driven by the conveyor belt, a sliding block slidably put on the reciprocating screw, an idler gear disposed at one end of the reciprocating screw, and a mount with the other end of the reciprocating screw rotatably disposed therein; two parallel guide rails with the reciprocating screw disposed therebetween, the guide rails having one ends secured to the mount; and a connection member with the other ends of the guide rails secured thereto, and the sliding block secured thereto, the connection member being secured to the scoop; wherein in response to turning on the forward and reverse switch, the motor shaft either (i) rotates clockwise to clockwise rotate the canopy about the scoop and extend the scoop out of the housing or (ii) rotates counterclockwise to counterclockwise rotate the canopy about the scoop and retract the scoop into the housing.

The above and other objects, features and advantages of the invention will become apparent from the following detailed description taken with the accompanying drawings.

DETAILED DESCRIPTION OF THE INVENTION

Figure 1:
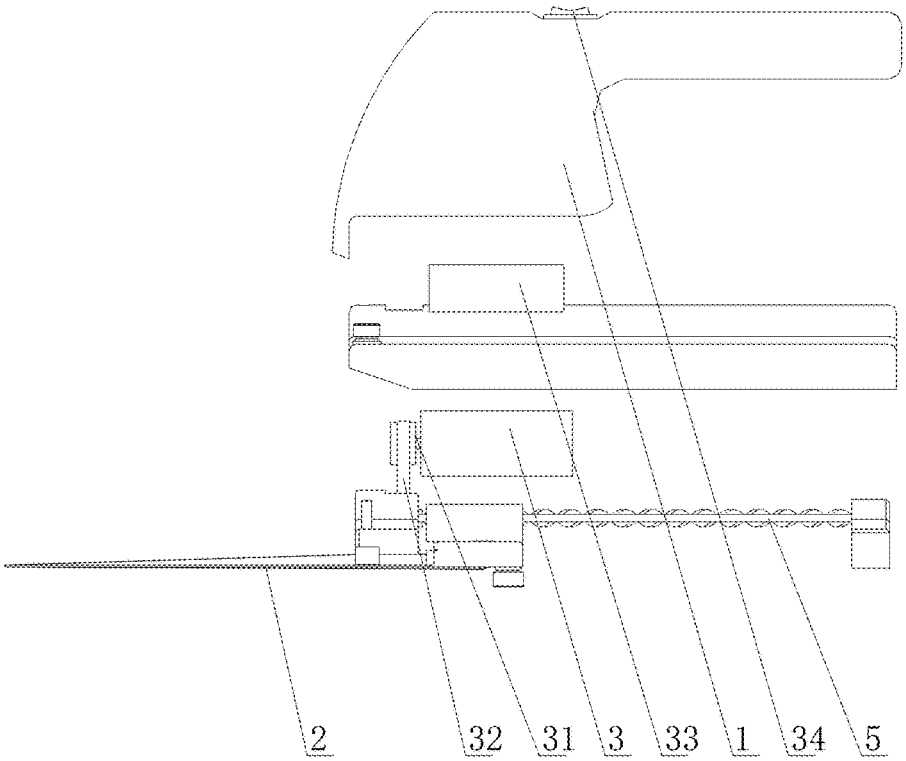
FIG. 1 is a side elevation, exploded view of a semisolid collection device according to the invention.
Figure 2:
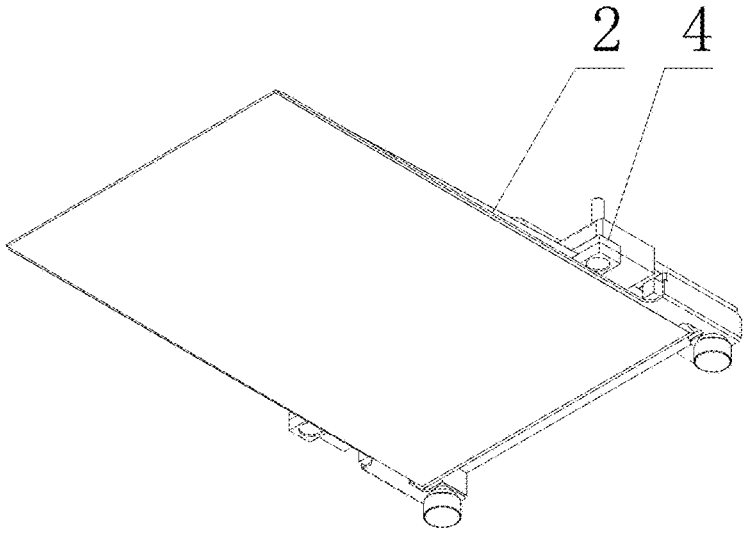
FIG. 2 is a perspective view of the shoveling assembly and the clamping assembly.
Figure 3:
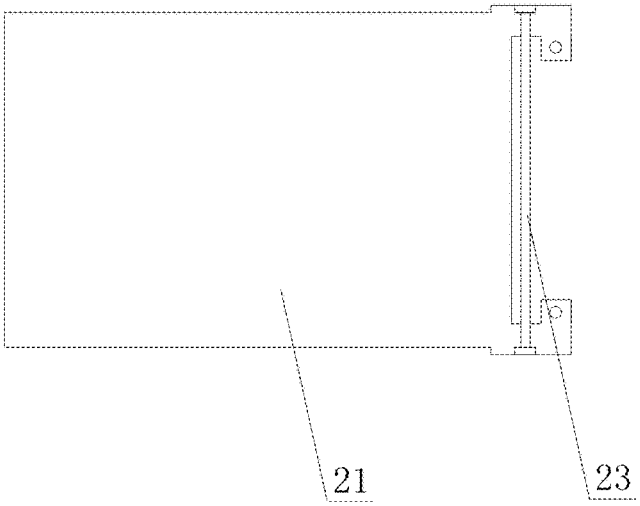
FIG. 3 is a top view of the scoop and the roller.
Figure 4:
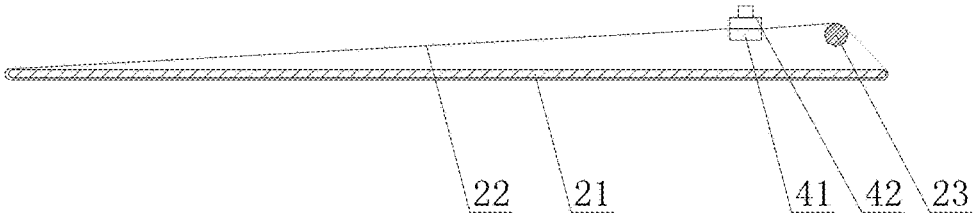
FIG. 4 is a sectional view of the shoveling assembly.
Figure 5:
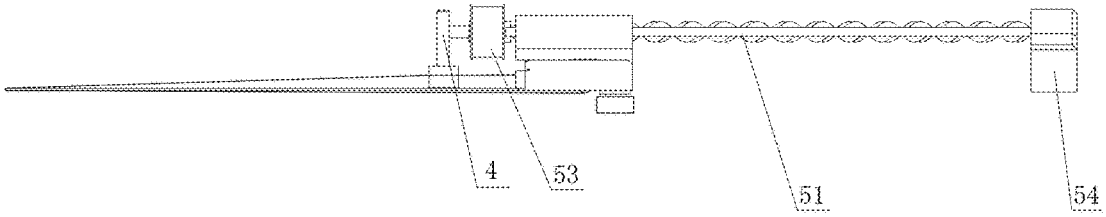
FIG. 5 is a side elevation of the shoveling assembly and the transmitting assembly.
Figure 6:
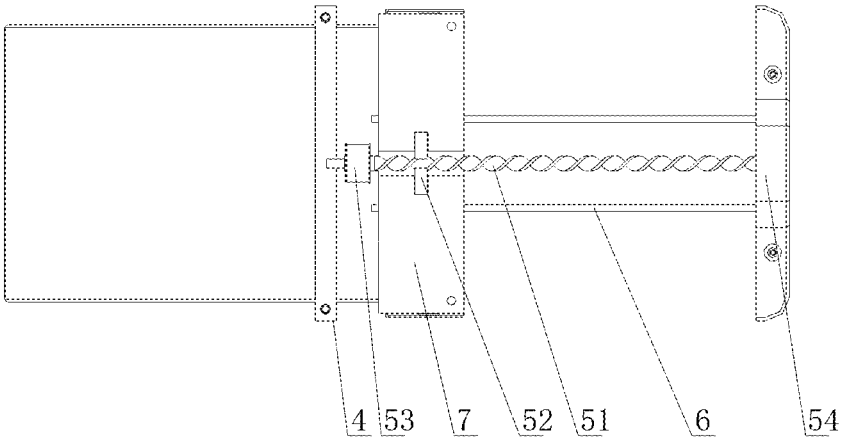
FIG. 6 is a top view of the scoop, the connection member, the guide rails, and associated components.
Figure 7:
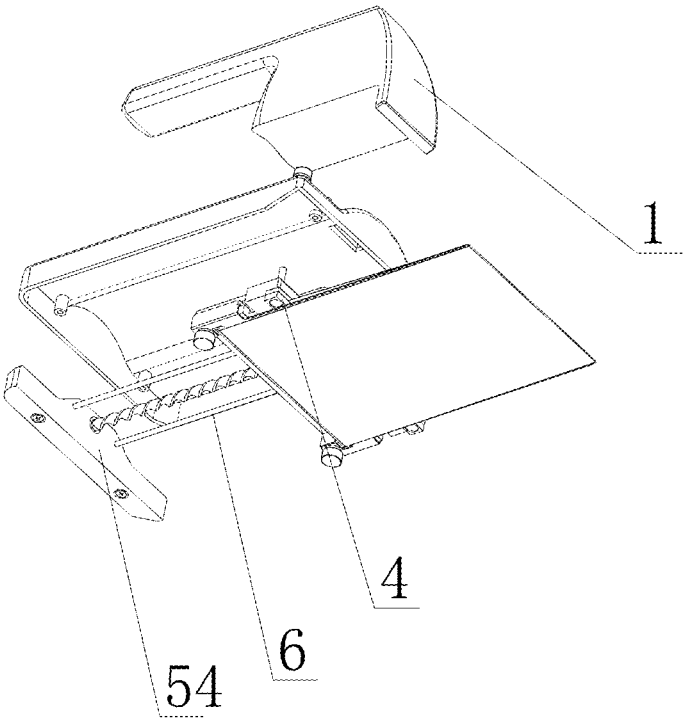
FIG. 7 is an exploded view of the housing, the shoveling assembly, the clamping assembly, the guide rails, and the transmitting assembly.

Referring to FIGS. 1 to 7, a semisolid (e.g., animal feces, grease, cakes, or towels) collection device in accordance with the invention comprises a housing 1; a shoveling assembly 2 in the housing 1 and including a scoop 21 extending out of the housing 1, a canopy 22 put on the scoop 21 and rotatable about the scoop 21, and a roller 23 above the scoop 21 with the canopy 22 moveably passing its surface; a motor 3 being activated by batteries or direct current (DC) power and including a motor shaft 31, a conveyor belt 32 driven by the motor shaft 31, a casing 33 for housing the motor 3, and a forward and reverse switch 34 mounted on the housing 1 for activating the motor 3 or not; a clamping assembly 4 secured to the housing 1 and disposed proximate to the roller 23, the clamping assembly 4 including first and second clamping plates 41, 42 with the canopy 22 passing therebetween; a transmitting assembly 5 including a reciprocating screw 51 driven by the conveyor belt 32, a sliding block 52 slidably put on the reciprocating screw 51, an idler gear 53 disposed at one end of the reciprocating screw 51, and a mount 54 with the other end of the reciprocating screw 51 rotatably disposed therein; two parallel guide rails 6 with the reciprocating screw 51 disposed therebetween, the guide rails 6 having one ends secured to the mount 54; and a connection member 7 with the other ends of the guide rails 6 secured thereto, and the sliding block 52 secured thereto, the connection member 7 being secured to the scoop 21.

Preferably, the canopy 21 is coated with nanomaterials to facilitate the carrying of the semisolid thereon in use, and cleaning of the canopy 21 after use.

In response to activating the motor 3 by turning on the forward button of the forward and reverse switch 34, the motor shaft 31 rotates clockwise. And in turn, the conveyor belt 32 rotates clockwise to clockwise rotate the reciprocating screw 51. Further, the sliding block 52 moves outward along the reciprocating screw 51. Furthermore, the connection member 7 moves outward along the guide rails 6. And in turn, the scoop 21 extends out of the housing 1 to scoop the semisolid. Also, the roller 23 rotates clockwise to clockwise rotate the canopy 22 about the scoop 21 to carry the semisolid toward the housing 1. Finally, the semisolid drops from the canopy 22 after passing the roller 23.

In response to activating the motor 3 by turning on the reverse button of the forward and reverse switch 34, the motor shaft 31 rotates counterclockwise. And in turn, the conveyor belt 32 rotates counterclockwise to counterclockwise rotate the reciprocating screw 51. Further, the sliding block 52 moves inward along the reciprocating screw 51. Furthermore, the connection member 7 moves inward along the guide rails 6. And in turn, the roller 23 rotates counterclockwise to counterclockwise rotate the canopy 22 about the scoop 21 and the scoop 21 gradually retracts into the housing 1.

While the invention has been described in terms of preferred embodiments, those skilled in the art will recognize that the invention can be practiced with modifications within the spirit and scope of the appended claims.

What is claimed is:

1. A device for collecting semisolid or solid, comprising:

a housing;

a shoveling assembly disposed in the housing and including a scoop, a canopy put on the scoop, and a roller disposed above the scoop with the canopy moveably passing its surface;

a motor including a motor shaft, a conveyor belt driven by the motor shaft, and a forward and reverse switch for activating the motor or not;

a clamping assembly secured to the housing and including first and second clamping plates with the canopy passing therebetween;

a transmitting assembly including a reciprocating screw driven by the conveyor belt, a sliding block slidably put on the reciprocating screw, an idler gear disposed at one end of the reciprocating screw, and a mount with the other end of the reciprocating screw rotatably disposed therein;

two parallel guide rails with the reciprocating screw disposed therebetween, the guide rails having one ends secured to the mount; and a connection member with the other ends of the guide rails secured thereto, and the sliding block secured thereto, the connection member being secured to the scoop;

wherein in response to turning on the forward and reverse switch, the motor shaft either (i) rotates clockwise to clockwise rotate the canopy about the scoop and extend the scoop out of the housing or (ii) rotates counterclockwise to counterclockwise rotate the canopy about the scoop and retract the scoop into the housing.

* * * * *